US005685126A

United States Patent [19]

Van Hoekelen

[11] Patent Number: 5,685,126

[45] Date of Patent: Nov. 11, 1997

[54] METHOD AND APPARATUS FOR COVERING AN ARTICLE WITH WRAPPING MATERIAL

[75] Inventor: Cornelis F. Van Hoekelen, Drums, Pa.

[73] Assignee: C & L International, Inc., McAdoo, Pa.

[21] Appl. No.: 562,470

[22] Filed: Nov. 24, 1995

[51] Int. Cl.[6] ..... B65B 41/12; B65B 49/00; B65B 51/02

[52] U.S. Cl. ..... 53/221; 53/370.3; 53/389.3; 53/397; 53/416; 53/580

[58] Field of Search ..... 53/464, 461, 221, 53/209, 397, 416, 580, 389.3, 370.3; 206/423

[56] References Cited

U.S. PATENT DOCUMENTS

| | | | |
|---|---|---|---|
| 3,479,789 | 11/1969 | Harrison | 53/221 X |
| 3,962,503 | 6/1976 | Crawford | 53/397 X |
| 4,733,521 | 3/1988 | Weder et al. | 53/580 |
| 5,076,874 | 12/1991 | Weder | 156/212 |
| 5,105,599 | 4/1992 | Weder | 53/399 |
| 5,339,565 | 8/1994 | Weder et al. | 47/72 |
| 5,408,800 | 4/1995 | Hsu | 53/221 |
| 5,410,856 | 5/1995 | Weder et al. | 53/397 |
| 5,450,707 | 9/1995 | Weder et al. | 53/464 X |
| 5,459,976 | 10/1995 | Weder et al. | 53/397 |
| 5,526,932 | 6/1996 | Weder | 53/397 X |

*Primary Examiner*—James F. Coan

*Attorney, Agent, or Firm*—Norman E. Lehrer

[57] ABSTRACT

A method and apparatus for securing wrapping material around an article. The apparatus includes a main frame that has a generally rectangular configuration. A spool member for supporting a roll of wrapping material is secured to one end of the main frame. A substantially planar surface with an opening formed therethrough is secured to and partially extends along the length of the main frame. A pulling assembly for grasping an end of the wrapping material from the roll and pulling the same away from the spool member is also secured the main frame. Positioned adjacent the spool member are first and second adhesive applying assemblies, each of which is adapted to apply a predetermined pattern of adhesive to a portion of the wrapping material. A cutting assembly for severing the adhesive covered portion of wrapping material from the roll is mounted to the main frame. A mold is located below the opening in the planar surface. Positioned above the mold and above the opening in the planar surface is a mandrel that is adapted to force the article and the adhesive covered portion of wrapping material into the mold so that the pattern of adhesive secures the wrapping material to the outer peripheral surface of the article.

17 Claims, 6 Drawing Sheets

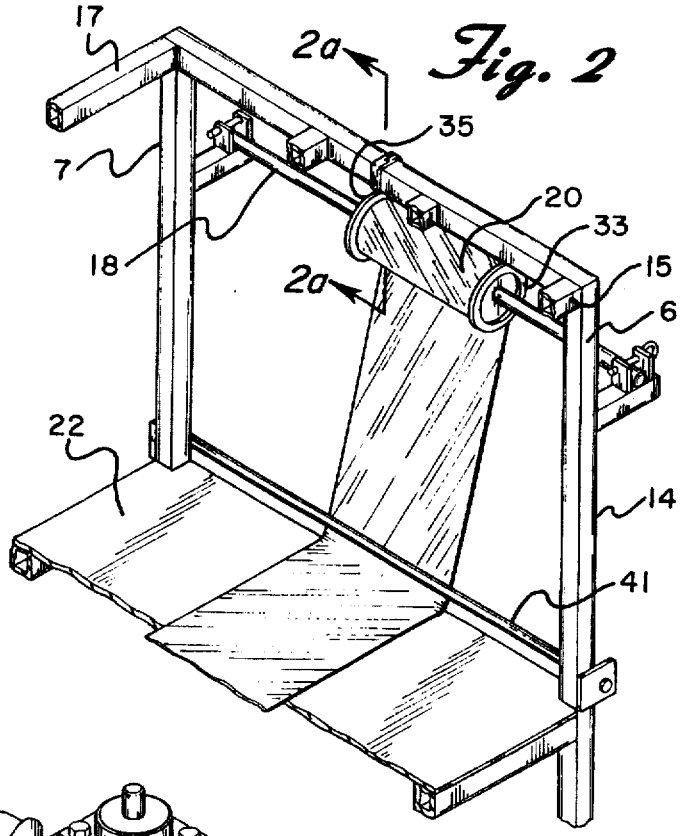
Fig. 2
Fig. 2a
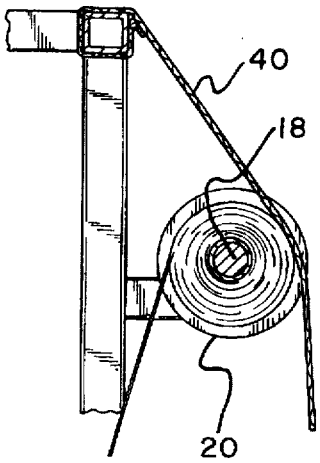
Fig. 3
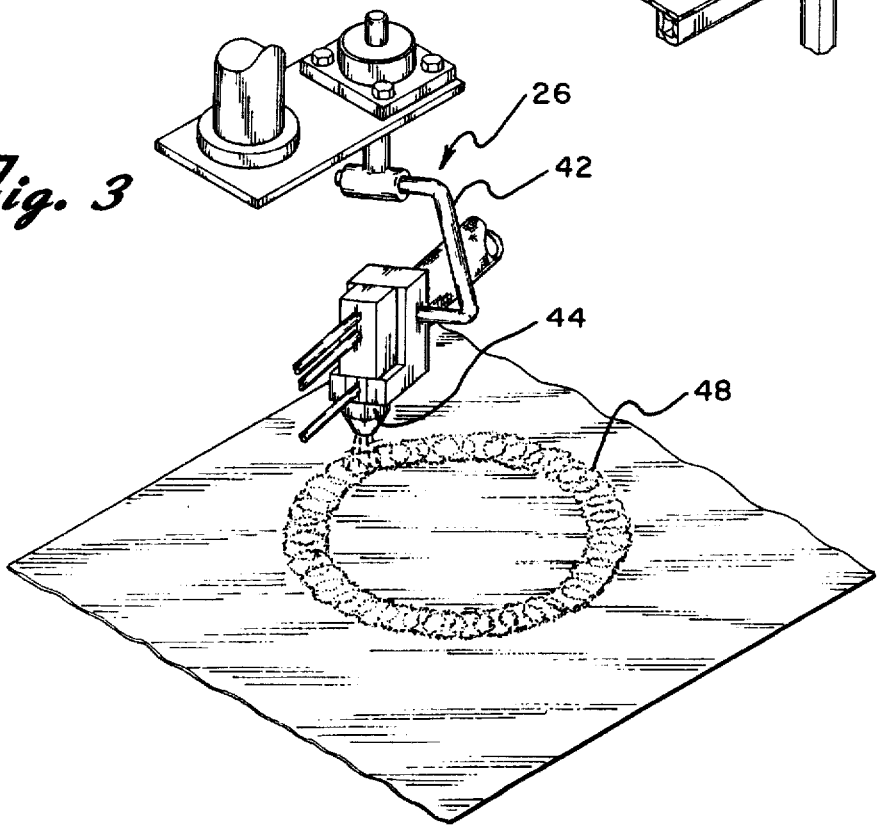

METHOD AND APPARATUS FOR COVERING AN ARTICLE WITH WRAPPING MATERIAL

BACKGROUND OF THE INVENTION

This invention relates to an apparatus for covering an article such as a flower pot or the like with wrapping material and, more particularly, to such an apparatus that automatically secures the wrapping material to the article quickly and efficiently. The present invention also relates to a method for covering an article with wrapping material.

The demand for articles, such as flower pots, that are covered with a decorative covering has steadily increased over the years. Covered flower pots are currently purchased for most major holidays, especially Christmas and Easter. They are also purchased in order to commemorate special occasions such as birthdays and the like or just to brighten a home or place of business.

Besides being decorative, the coverings are often made of waterproof materials such as aluminum foil, Mylar or other plastic films which prevent leakage of water from the bottom of the flower pot. The coverings also insulate the flower pots from drastic temperature changes. Accordingly, the coverings are useful to florists and the nursery industry in general.

Since the demand for flower pots covered with decorative material is so great, there is a concomitant demand for a machine that can automatically cover a flower pot with decorative material. Such a machine would eliminate the manufacturing costs that would be attributed to employing workers to manually secure the wrapping material to the flower pots.

In recognition of the need to quickly and efficiently wrap large numbers of flower pots and the like, several methods and machines have been proposed. For example, U.S. Pat. No. 4,733,521 discloses a wrapping machine for covering a flower pot with a sheet of material. A drawback with this device is that the application of adhesive to the wrapping material is not done automatically. Furthermore, the device is not adapted to advance a plurality of successive flower pots through the machine.

U.S. Pat. No. 5,105,599 discloses a method for wrapping a flower pot using a cover forming device and a lower banding device. Once again, the wrapping material and the flower pots are not automatically advanced through the machine. Another drawback with this method is that it is relatively complex as it requires that a new band be placed in a mold every time the pot and wrapping material are inserted therethrough in order to secure the latter to the former.

SUMMARY OF THE INVENTION

The present invention is designed to overcome the deficiencies discussed above. It is an object of the present invention to provide an apparatus that can quickly and efficiently cover an article such as a flower pot with wrapping material.

It is a further object to provide a method of covering an article with wrapping material.

In accordance with the illustrative embodiments, demonstrating features and advantages of the present invention, there is provided an apparatus for securing wrapping material around an article. The apparatus includes a main frame that has a generally rectangular configuration. A spool member that is adapted to support a roll of wrapping material is secured adjacent one end of the main frame. A substantially planar surface with an opening formed therethrough is secured to and partially extends along the length of the frame. A pulling assembly that is adapted to grasp an end of the wrapping material from the roll and pull the same away from the spool member is also secured to the main frame. First and second adhesive applying means are positioned adjacent the spool member for applying a predetermined pattern of adhesive to a portion of the wrapping material. A cutting assembly mounted to the main frame is adapted to sever the adhesive covered portion of wrapping material from the roll. A mold is positioned below the opening in the planar surface. Positioned above the opening in the planar surface is a mandrel that is adapted to force the article and the portion of wrapping material into the mold so that the pattern of adhesive secures the wrapping material to the outer peripheral surface of the article.

Other objects, features and advantages will be readily apparent from the following detailed description of a preferred embodiment of the invention taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

FIG. 2 is a partial perspective view taken along lines 2—2 of FIG. 1;

FIG. 2a is a partial side cross-sectional view taken along lines 2a–2a FIG. 2;

FIG. 3 is a partial perspective view taken along lines 3—3 of FIG. 1;

Detailed Description of the Preferred Embodiment

Figure 1:
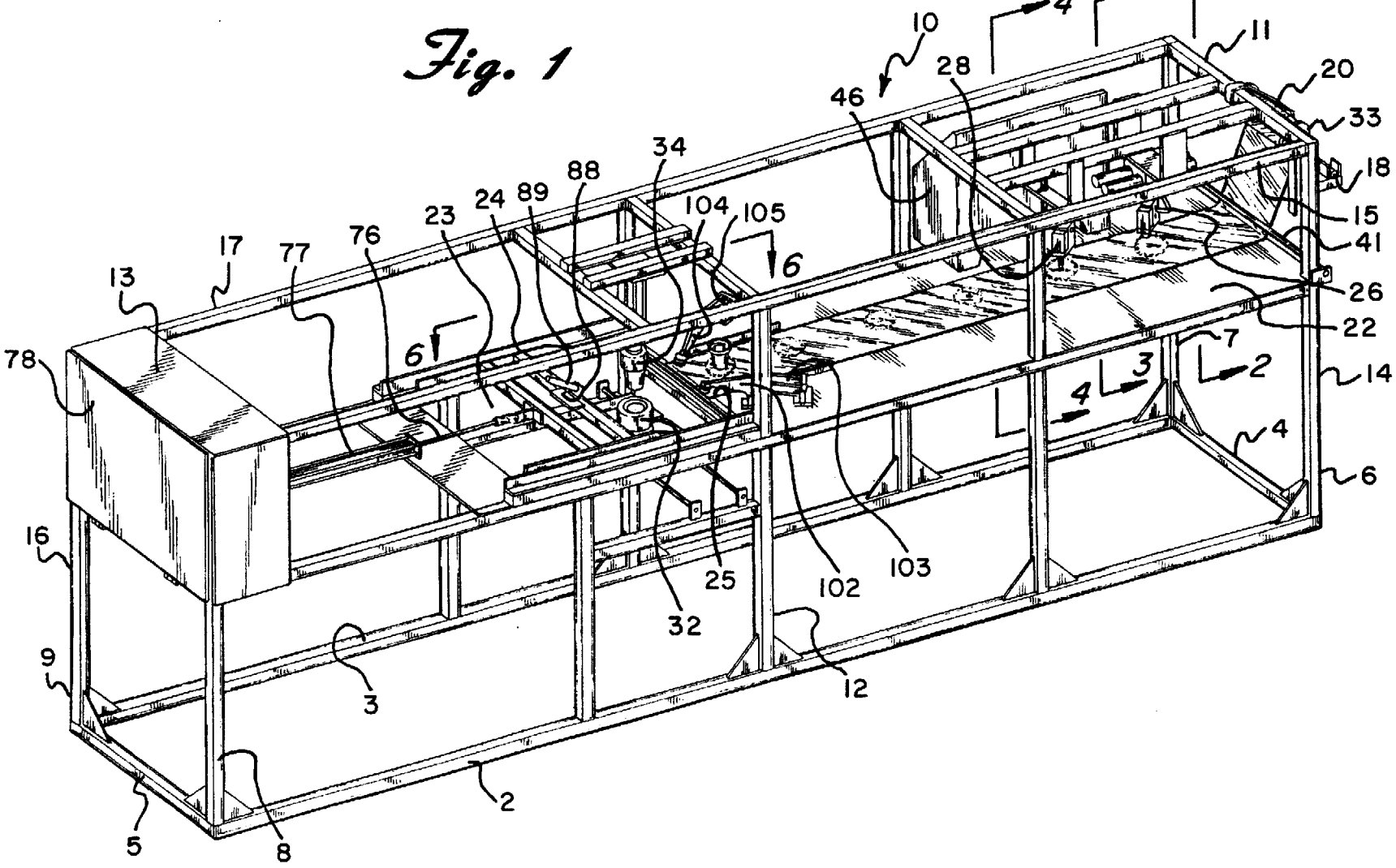
FIG. 1 is a perspective view of the article covering apparatus of the present invention.

Referring now to the drawings in detail, wherein like reference numerals have been used throughout the various figures to designate like elements, there is shown in FIG. 1 an apparatus for covering an article with wrapping material constructed in accordance with the principles of the present invention and designated generally as 10.

The covering apparatus 10 includes a main frame 12 that has a first end 14 and a second end 16. A spool member 18 is secured to the first end 14 of the main frame 12. The spool member is adapted to support a roll 20 of wrapping material. A substantially planar surface 22 is secured to and partially extends along the length of the main frame 12. An elongated rectangular opening 23 is formed in the planar surface 22. Secured adjacent the second end 16 of the main frame 12 is a pulling assembly 24 for pulling one end 25 of the wrapping material away from the roll as more fully described below. First and second adhesive applying assemblies 26 and 28 are secured to the main frame 12 adjacent the spool member 18. Each of the adhesive applying assemblies is adapted to apply a predetermined pattern of adhesive to the top of a portion of the wrapping material.

Figure 6:
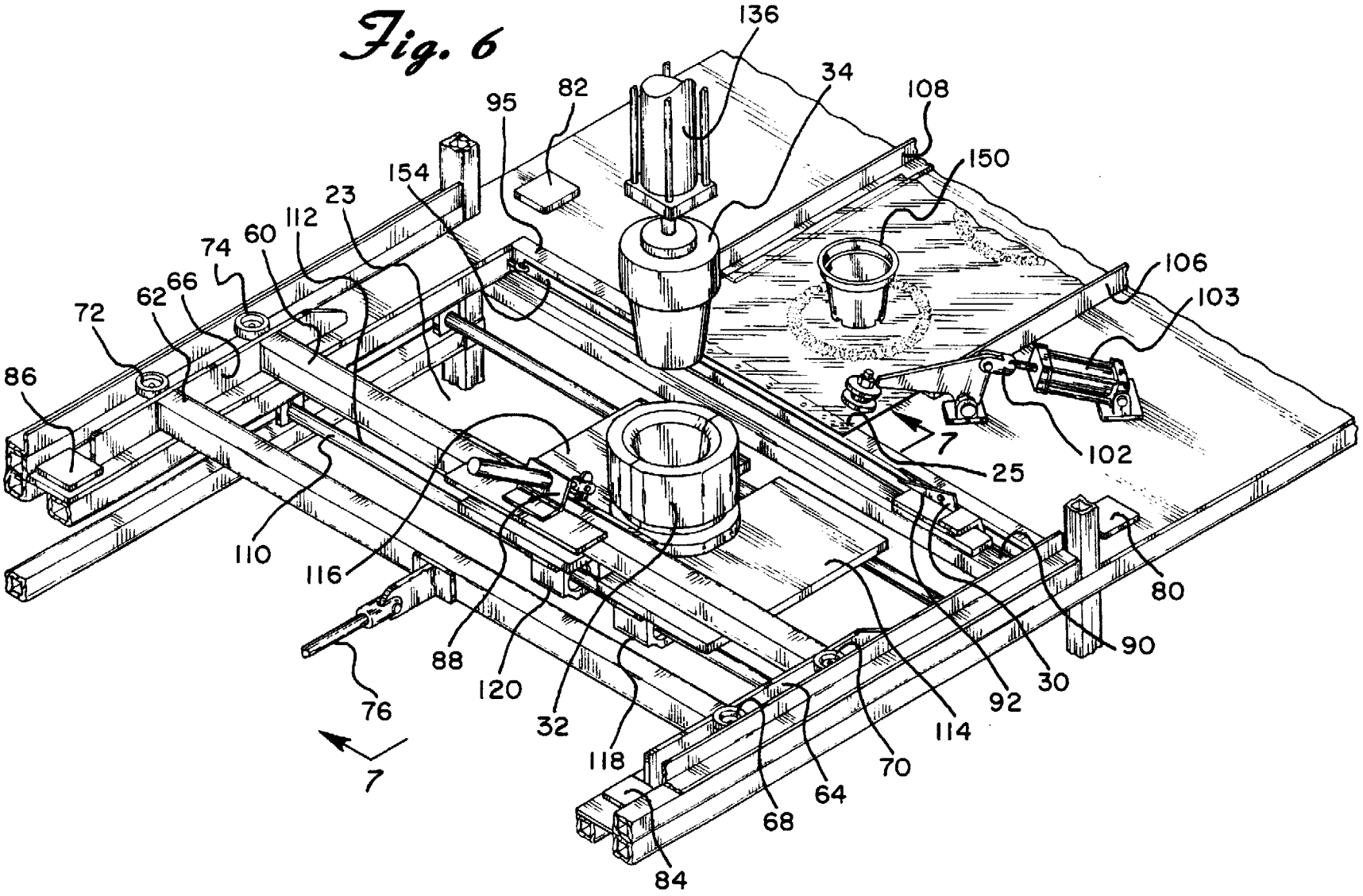
FIG. 6 is a top perspective view taken along lines 6—6 of FIG. 1.

A cutting assembly 30 for severing the above mentioned portion of wrapping material from the roll is slidably secured along the width of the main frame (see FIG. 6). A two part mold 32 is located below the level of the planar surface 22 adjacent the cutting assembly 30. Positioned above the level of the planar surface is a mandrel 34 that is adapted to force an article to be wrapped together with the wrapping material into the mold 32 as more fully described below.

The main frame 12 is preferably in the form of an elongated rectangular box and is constructed out of a plurality of tubular metal members that have a rectangular cross-section (see FIG. 1). More specifically, the main frame includes two spaced apart lower longitudinal tubular members 2 and 3 connected at their respective ends by lower latitudinal tubular members 4 and 5. Tubular members 6 and 7 extend upwardly from opposite ends of latitudinal tubular member 4. Similarly, tubular members 8 and 9 extend upwardly from opposite ends of latitudinal tubular member 5. Projecting between the upper ends of tubular members 6, 7 and tubular members 8, 9 are upper latitudinal tubular members 11 and 13, respectively. Spaced apart upper longitudinal tubular members 15 and 17 extend between opposite ends of upper latitudinal tubular members 11 and 13. Additional tubular members are added to give the main frame increased structural support.

Referring to FIG. 2, the roll 20 of wrapping material is shown mounted on spool member 18. Disks 33 and 35 are each mounted on the spool adjacent a corresponding end of the roll of wrapping material. The disks act as a guide for the wrapping material as it is withdrawn from the roll so that the same does not drift laterally. The wrapping material has one end secured to the roll and a leading edge 25 extending therefrom (see FIG. 1). The spool member 18 extends between the upwardly projecting tubular members 6 and 7 and has its ends secured thereto. In the preferred embodiment, a belt 40, that has one end secured to upper latitudinal tubular member 11, extends downwardly over a side of the roll 20 of wrapping material so that a portion of the belt contacts the wrapping material (see FIG. 2*a*). The other end of the belt preferably has a weight (not shown) attached thereto. The weight causes the belt 40 to firmly contact the wrapping material in order keep the wrapping material in a tightly wound roll. A material guide 41 extends between tubular members 6 and 7 immediately above the planar surface 22.

Referring to FIG. 3, a first adhesive applying assembly 26 is shown secured to the main frame. The first adhesive applying assembly includes a rotary actuator 42 that has a nozzle 44 extending downwardly therefrom. The rotary actuator 42 is adapted to spray a circular ring of adhesive through the nozzle 44 upon actuation of an interconnected hot melt glue apparatus 46 of the type known in the relevant art (see FIGS. 1 and 3). In the preferred embodiment, the nozzle 44 has three separate air lines which operate in conjunction with signals received from the glue apparatus 46 to eject the adhesive in a circular swirled pattern 48.

Figure 4:
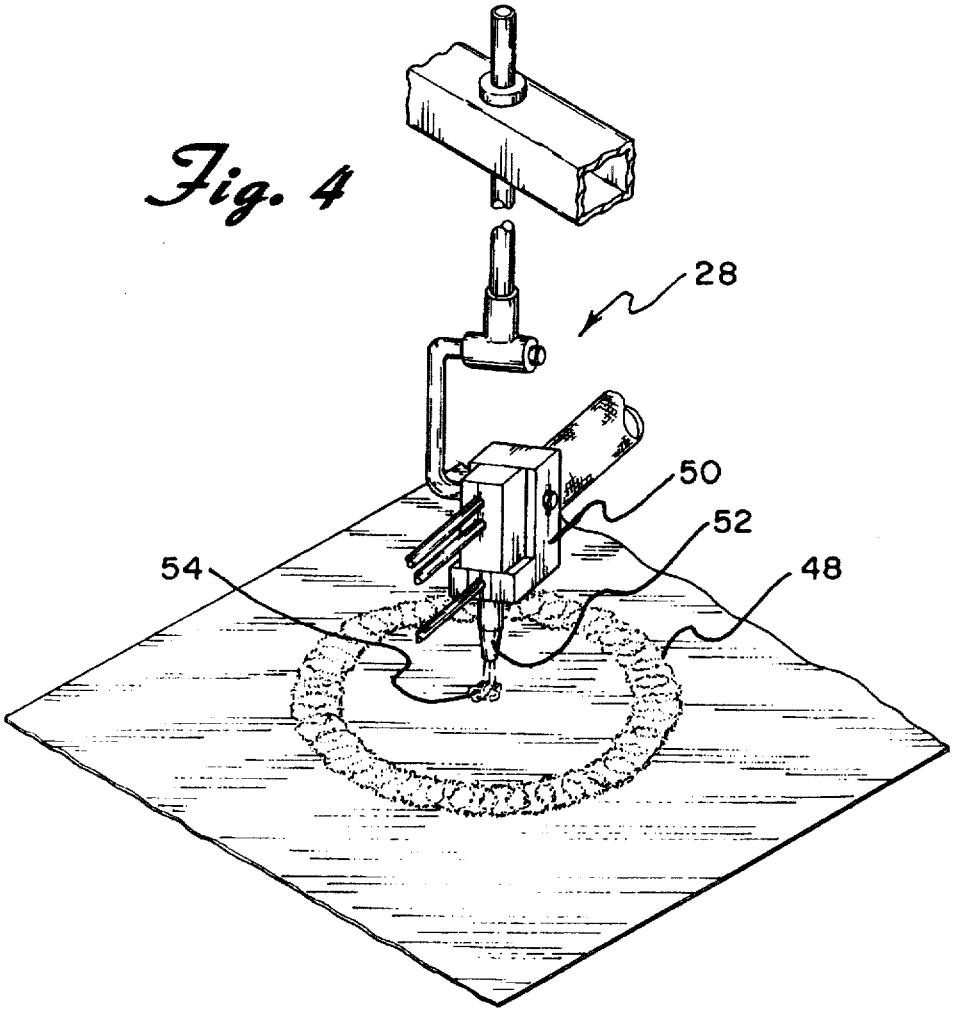
FIG. 4 is a partial perspective view taken along lines 4—4 of FIG. 1.
Figure 5:
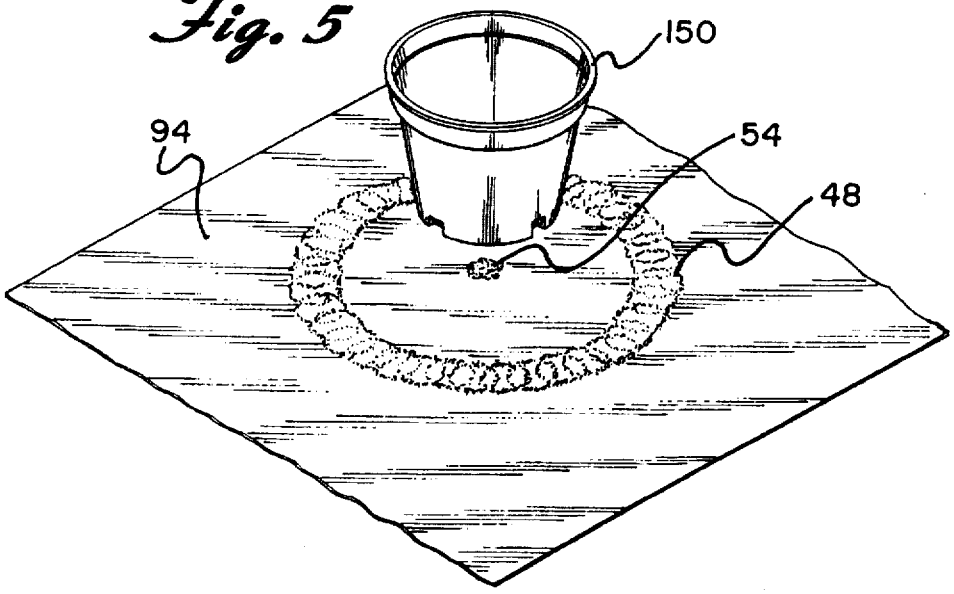
FIG. 5 is a perspective view of a flower pot positioned above an adhesive covered portion of wrapping material.

Referring to FIG. 4, the second adhesive applying assembly 28 is shown. Assembly 28 is also interconnected to the hot melt glue apparatus 46 and has an actuator 50 with a nozzle 52 extending downwardly therefrom. Upon proper actuation, the second adhesive assembly 28 receives an amount of adhesive from the glue apparatus and delivers the same through the actuator 50 and out of the nozzle 52 in the form of a dot 54. The dot is preferably placed in the center of the circular ring 48 of adhesive as more fully described below.

Figure 7:
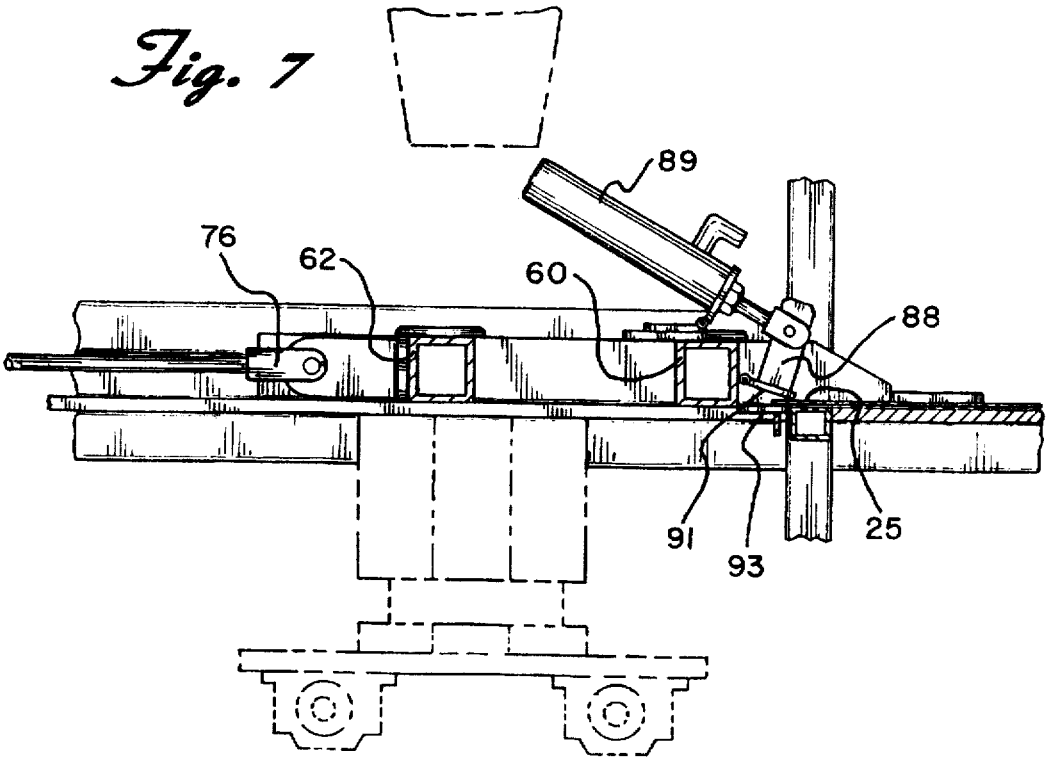
FIG. 7 is a side cross-sectional view taken along lines 7—7 of FIG. 6.
Figure 8:
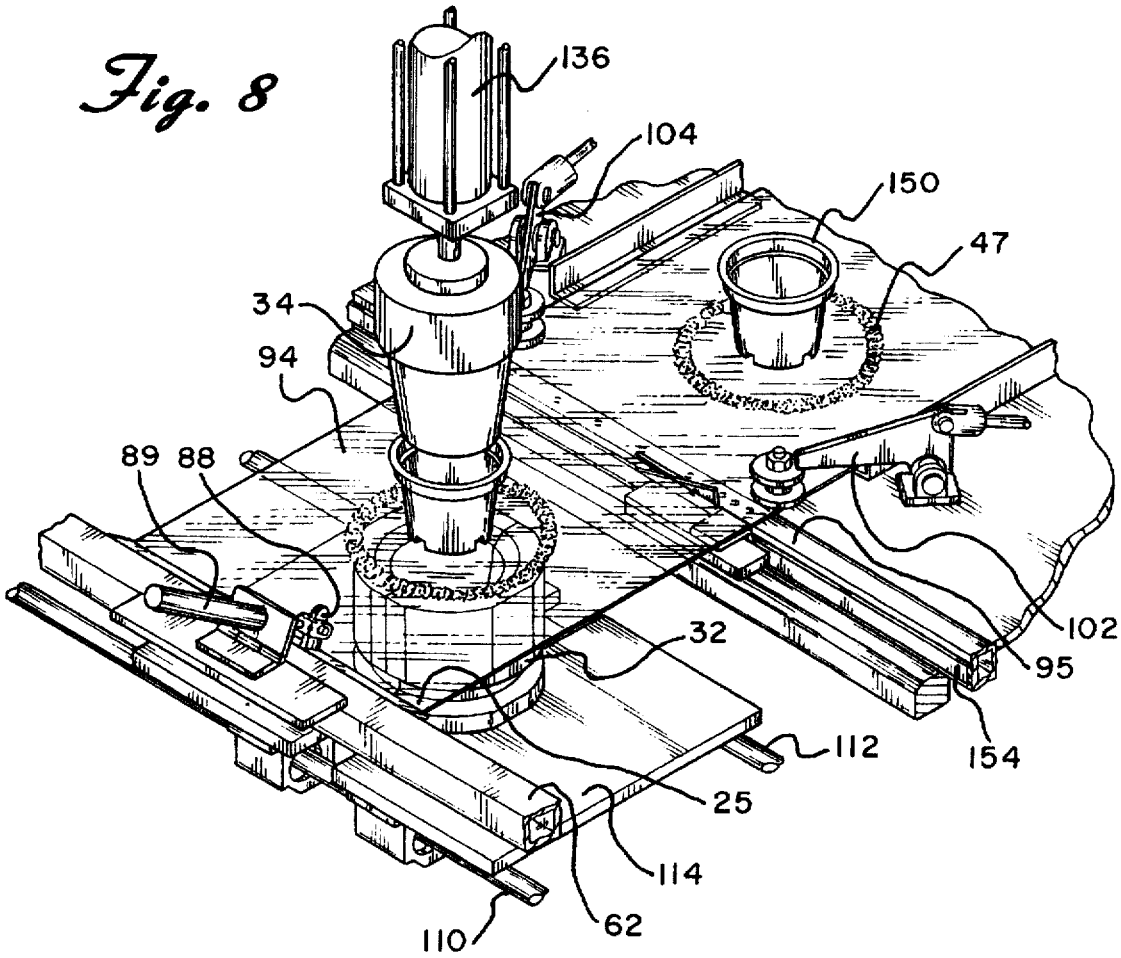
FIG. 8 is a perspective view showing the mandrel above the flower pot and the mold.

Referring to FIGS. 6 through 8, the pulling and cutting assemblies 24 and 30, respectively, are shown. The pulling assembly 24 includes transverse bar members 60 and 62. The ends of each of the bar members 60 and 62 are connected to one another by sliding bars 64 and 66. Each sliding bar is movably connected to a corresponding side of the main frame 12 by rollers 68, 70 and 72, 74. The pulling assembly is adapted to move toward and away from the first end 14 of the main frame 12 by means of a pusher 76 that has one end secured to the bar member 62 and an opposite end secured to a pneumatic cylinder 77. The pneumatic cylinder communicates with control box 78 in a manner known in the art to move the pusher 76 closer to or further from the first end 14 of the main frame 12 (see FIG. 1) depending on the signal received.

The pulling assembly 24 can move toward the first end 14 of the main frame until each of the sliding bars 64 and 66 contacts a corresponding stop member 80 and 82, which are secured to the top of the planar surface 22. Similarly, the pulling assembly 24 can move away from the first end 14 of the main frame 12 until each of the sliding bars contacts a corresponding stop member 84 and 86.

A gripping member 88 having upper and lower jaw members 91 and 93 is secured to the transverse bar member 60 and is associated with a pneumatic cylinder 89. The pneumatic cylinder 89 is connected to control box 78 amd causes the jaw members 91 and 93 to grasp the end 25 of the wrapping material upon proper actuation.

Extending adjacent one end of the elongated opening 23 is vacuum bar 95. The vacuum bar has a plurality of holes formed therein. A vacuum source (not shown) is connected to the underside of the bar 95 to provide suction through the holes. Accordingly, when the leading edge 25 of wrapping material extends over the holes in the bar 95, the vacuum source is actuated so that the material is forced against the vacuum bar.

Cutting assembly 30 includes a guide bar 90 which extends underneath the planar surface 22 adjacent the vacuum bar 95. Pneumatic cutter member 92 is slidably mounted along the length of the guide bar 90. The cutter member is adapted to cut a portion 94 of the wrapping material away from the roll 20 as it moves along the length of the guide bar 90 upon actuation from the control box 78 (see FIG. 8). It should be noted that since the guide bar 90 is spaced from the vacuum bar 95, the leading edge 25 of the roll 20 of wrapping material extends passed the vacuum bar 95 and partially over the opening 23 in the planar surface 22 once the portion 94 is cut away from the roll. This allows the jaw members 91 and 93 of the gripping member 88 to grasp the leading edge 25 upon actuation of pneumatic cylinder 89 as more fully described below.

Clamping members 102 and 104 are adapted to secure opposite sides of the wrapping material against the planar surface 22 upon actuation of pneumatic cylinders 103 and 105, respectively, to facilitate the severing of a portion of the wrapping material from the roll 20 by pneumatic cutter member 92 (see FIG. 8). Opposing guide rails 106 and 108 are secured to the top of planar surface 22 to accurately position the wrapping material when end 25 is pulled towards the second end 16 of the main frame 12 as more fully described below.

Figure 9:
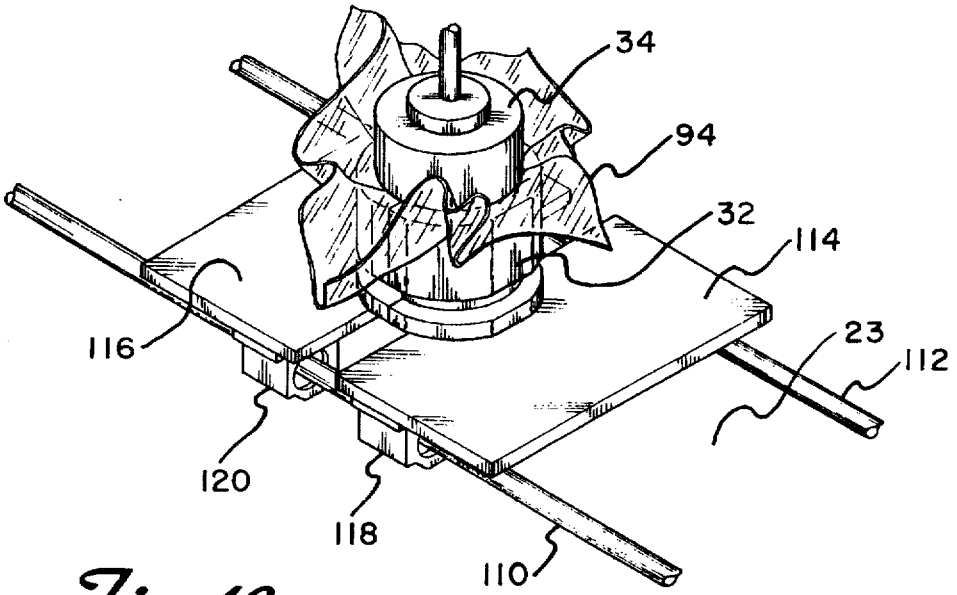
FIG. 9 is a perspective view of the mandrel and pot shown inserted into the mold.
Figure 10:
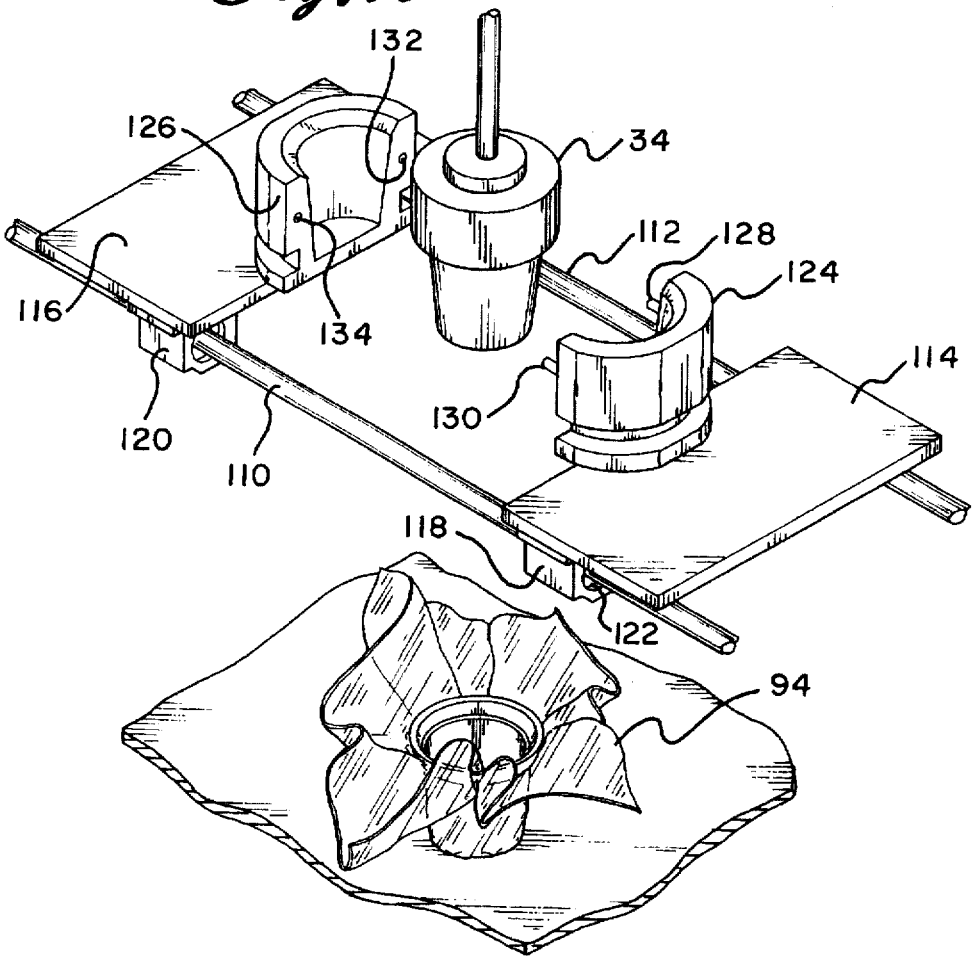
FIG. 10 is a perspective view of the flower pot covered with wrapping material and positioned below two separated half mold segments.

Referring to FIGS. 9 and 10, a pair of guide rods 110 and 112 are secured to opposite sides of the main frame 12 and extend the width of the opening 23 in the planar surface 22. Platforms 114 and 116 are slidably mounted along the length of the guide rods 110 and 112. More specifically, each platform has a slide bearings 118 and 120 secured to the bottom thereof. The slide bearings 118 and 120 are substantially identical to each other. Accordingly, only one of the slide bearings will be described in detail, it being understood that the description applies equally to the other slide bearing. The slide bearing 118 has a pair of apertures 122 formed therethrough. Each of the guide rods 110 and 112 extends through a corresponding one of the apertures. A pneumatic cylinder (not shown) is associated with the slide bearing 118 to cause platform 114 to move toward or away from platform 116.

Mold 32 includes half mold segments 124 and 126. Each mold segment is mounted on a corresponding platform 114 and 116. Half mold segment 124 includes pins 128 and 130 which extend from opposite sides thereof. Half mold segment 126 includes holes 132 and 134 formed in opposite sides thereof. Each hole is adapted to receive a corresponding pin when the platforms 114 and 116 are brought together. With the pins positioned in the holes, the half mold segments form female cavity mold 32.

The mandrel 34 is secured to and extends downwardly from a pneumatic cylinder 136. Cylinder 136 is connected to the top of the main frame 12. The mandrel is adapted to move downwardly through the opening 23 and into the mold 32 upon actuation of the pneumatic cylinder 136 (see FIG. 6).

In order to facilitate an understanding of the principles associated with the foregoing method and apparatus, its operation will now be briefly described. A roll 20 of wrapping material is mounted on the spool member 18 between disks 33 and 35. The wrapping material is preferably colored plastic film or aluminum foil. However, the wrapping material can be other material such as paper. End 25 of wrapping material is pulled away from the roll and between material guide 41 and the planar surface 22. The end of the material is then passed slightly beyond the first glue assembly 26. Thereafter, a rotary actuator 42 ejects a circular ring 48 of adhesive through nozzle 44 upon actuation of the interconnected hot melt glue apparatus 46 (see FIGS. 1 and 3). Thereafter, the portion of the wrapping material with the ring of adhesive placed thereon is positioned under the second glue assembly 28 where a drop of adhesive 54 is ejected through nozzle 52 and into the center of the ring of adhesive 48 upon actuation of the hot melt glue apparatus.

The end 25 of the wrapping material is then passed between guide rails 106 and 108 and positioned slightly passed the vacuum bar 95. At this time, a flower pot 150 or the like is deposited between the ring of adhesive so that its bottom contacts and is secured to the dot 54 of adhesive. The flower pot can be manually dropped onto the dot of adhesive or it can be automatically deposited thereon by some form of conveyor means (not shown). It should be noted that the outer diameter of the flower pot 150 is slightly smaller than the inner diameter of the mold 32. Additionally, the half mold segments 124 can be replaced with larger or smaller segments in order to accommodate flower pots 150 of different sizes.

Pneumatic cylinder 77 is then actuated to move the pulling assembly 24 via the pusher 76, which is associated therewith, towards the end 25 of the wrapping material until the gripping member 88 is positioned immediately above the same. Thereafter, the pneumatic cylinder 89 is actuated to cause the gripping member to grip the end of the wrapping material between jaw members 91 and 93 as best shown in FIG. 7. The pulling assembly 24 is then pulled towards the second end 16 of the main frame 12 until a portion 94 of the wrapping material extends over the mold 32.

Pneumatic cylinders 103 and 105 are then actuated to cause clamping members 102 and 104, respectively, to clamp the sides of the wrapping material against the planar surface 22 (see FIG. 8). Vacuum bar 95 then draws an end of the portion 94 of the wrapping material against the same through the plurality of holes formed therein which are associated with a vacuum source.

Thereafter, the portion 94 of the wrapping material is then cut away from the roll 20 of wrapping material. This is accomplished by actuating the cutting assembly 30 so that the cutter member 92 cuts the wrapping material widthwise. In the preferred embodiment, a support strip 154 is secured adjacent the vacuum bar 95. The strip 154 supports the cut end of the wrapping material in order to prevent the same from dropping through the opening 23 in the planar surface. Otherwise, the gripping of the cut end by the jaw members 91 and 93 would be hampered.

Pneumatic cylinder 136 is then actuated to move the mandrel 34 down into the flower pot 150 so that the flower pot and the severed portion 94 of wrapping material are forced down into the mold 32 (see FIG. 9). As the portion 94 of wrapping material enters the mold together with the flower pot 150, the circular ring of adhesive 48 is forced against the upper periphery of the flower pot. Accordingly, the portion 94 of the wrapping material is firmly secured to the flower pot.

The half mold segments 124 and 126 are then moved away from one another. This is accomplished by actuating the pneumatic cylinders associated with the slide bearings 118 and 120 to cause platforms 114 and 116 to separate (see FIG. 10). When the mold segments 124 and 126 are moved away from one another, the wrapped flower pot drops downwardly away from the mandrel 34 by the force of gravity. It should be noted that the flower pot can be dropped onto an out feed conveyor or the like or it can be vertically nested with other wrapped flower pots.

The mandrel is then moved upwardly and the mold segments are once again brought together to form a complete mold. The clamping members 102 and 104 release the wrapping material so that the pulling assembly and the attached gripping member can once again grab the leading edge of the wrapping material and pull the same over the mold 32 so that another flower pot can be successfully wrapped. This procedure is repeated until the desired number of flower pots are wrapped.

The present invention may be embodied in other specific forms without departing from the spirit or essential attributes thereof and accordingly reference should be made to the appended claims rather than to the foregoing specification as indicating the scope of the invention.

What is claimed is:

1. An apparatus for securing wrapping material around an article having a bottom, a top end and an outer peripheral surface comprising:

a main frame having a first end and a second end;

a substantially planar surface secured to and partially extending along the length of said main frame;

pulling means for moving an end of a roll of wrapping material toward said second end of said main frame;

adhesive applying means positioned adjacent said first end of said main frame for applying a pattern of adhesive to a portion of said wrapping material, said adhesive applying means including a first adhesive assembly, a second adhesive assembly spaced from said first adhesive assembly and an adhesive supplying source for supplying said first and second adhesive assemblies with adhesive, said first adhesive assembly including a nozzle adapted to apply a ring of adhesive on said portion of wrapping material;

cutting means for severing said portion of wrapping material from said roll, and means for causing said portion of wrapping material to contact said outer peripheral surface of said article.

2. The apparatus of claim 1 further including supporting means for supporting said roll of wrapping material, said supporting means being secured to said first end of said main frame.

3. The apparatus of claim 2 wherein said supporting means includes a spool secured to said first end of said main frame above said planar surface, said roll of wrapping material being adapted to fit over said spool.

4. The apparatus of claim 1 further including means for placing said article on said portion of wrapping material so that said adhesive secures said bottom of said article to said portion of wrapping material.

5. The apparatus of claim 1 wherein said planar surface has an opening formed therethrough, said opening being located adjacent said second end of said main frame.

6. The apparatus of claim 5 wherein said means for causing said portion of wrapping material to contact said outer peripheral surface of said article includes:

a mold positioned below said opening in said planar surface, and means for forcing said article and said portion of wrapping material into said mold so that said pattern of adhesive secures said wrapping material to said outer peripheral surface of said article.

7. The apparatus of claim 6 wherein said forcing means includes a mandrel mounted to said main frame, said mandrel being vertically movable into and out of said opening for moving said article and said wrapping material into said mold.

8. The apparatus of claim 5 wherein said pulling means includes:

a gripping member having upper and lower jaw members, said jaw members being adapted to grasp said end of said wrapping material, and means for moving said gripping member longitudinally along said opening.

9. The apparatus of claim 1 wherein said adhesive applying means includes a first adhesive assembly, a second adhesive assembly spaced from said first adhesive assembly and an adhesive supplying source for supplying said first and second adhesive assemblies with adhesive.

10. The apparatus of claim 1 wherein said cutting means includes:

a guide bar secured under said opening in said planar surface;

a cutter member slidably mounted along the length of said guide bar for cutting a portion of the wrapping material away from the roll.

11. The apparatus of claim 1 wherein said second adhesive assembly includes a nozzle to apply a quantity of adhesive material in the center of said ring of adhesive.

12. The apparatus of claim 10 further including clamping means for releasably securing said wrapping material to said planar surface.

13. An apparatus for securing wrapping material around an article having a bottom, a top end and an outer peripheral surface comprising:

a main frame having a first end and a second end;

a substantially planar surface secured to and partially extending along the length of said main frame and having an opening formed therethrough adjacent said second end of said main frame;

pulling means for moving an end of a roll of wrapping material toward said second end of said main frame;

adhesive applying means positioned adjacent said first end of said main frame for applying a pattern of adhesive to a portion of said wrapping material;

cutting means for severing said portion of wrapping material from said roll, and means for causing said portion of wrapping material to contact said outer peripheral surface of said article including a mold positioned below said opening in said planar surface, and means for forcing said article and said portion of wrapping material into said mold so that said pattern of adhesive secures said wrapping material to said outer peripheral surface of said article.

14. The apparatus of claim 13 wherein said forcing means includes a mandrel mounted to said main frame, said mandrel being vertically movable into and out of said opening for moving said article and said wrapping material into said mold.

15. The apparatus of claim 13 wherein said pulling means includes:

a gripping member having upper and lower jaw members, said jaw members being adapted to grasp said end of said wrapping material, and means for moving said gripping member longitudinally along said opening.

16. An apparatus for securing wrapping material around an article having a bottom, a top end and an outer peripheral surface comprising:

a main frame having a first end and a second end;

a substantially planar surface secured to and partially extending along the length of said main frame;

pulling means for moving an end of a roll of wrapping material toward said second end of said main frame;

adhesive applying means positioned adjacent said first end of said main frame for applying a pattern of adhesive to a portion of said wrapping material;

cutting means including a guide bar secured under said opening in said planar surface and a cutter member slidably mounted along the length of said guide bar for cutting a portion of the wrapping material away from the roll, and means for causing said portion of wrapping material to contact said outer peripheral surface of said article.

17. The apparatus of claim 16 further including clamping means for releasably securing said wrapping material to said planar surface.

* * * * *